US010174405B2

(12) United States Patent
Svenningsson et al.

(10) Patent No.: US 10,174,405 B2
(45) Date of Patent: Jan. 8, 2019

(54) BRASS ALLOY COMPRISING CERAMIC ALUMINA NANOPARTICLES AND HAVING IMPROVED MACHINABILITY

(71) Applicant: Nordic Brass Gusum AB, Gusum (SE)

(72) Inventors: Inge Svenningsson, Sandviken (SE); Jan Nilsson, Älmhult (SE)

(73) Assignee: Nordic Brass Gusum AG, Gusum (SE)

( * ) Notice: Subject to any disclaimer, the term of this patent is extended or adjusted under 35 U.S.C. 154(b) by 0 days.

(21) Appl. No.: 15/036,138

(22) PCT Filed: Nov. 12, 2014

(86) PCT No.: PCT/EP2014/074384

§ 371 (c)(1),
(2) Date: May 12, 2016

(87) PCT Pub. No.: WO2015/071316

PCT Pub. Date: May 21, 2015

(65) Prior Publication Data

US 2016/0265088 A1 Sep. 15, 2016

(30) Foreign Application Priority Data

Nov. 13, 2013 (SE) ..... 1351337-9

(51) Int. Cl.

| | |
|---|---|
| ***C22C 1/10*** | (2006.01) |
| ***C22C 1/02*** | (2006.01) |
| ***C22C 9/04*** | (2006.01) |
| ***C22C 1/04*** | (2006.01) |

(52) U.S. Cl.
CPC ..... *C22C 1/1036* (2013.01); *C22C 1/02* (2013.01); *C22C 1/0425* (2013.01); *C22C 9/04* (2013.01)

(58) Field of Classification Search
CPC ..... C22C 1/0425; C22C 9/00; C22C 1/1036; C22C 9/04
USPC ..... 420/477
See application file for complete search history.

(56) References Cited

U.S. PATENT DOCUMENTS

| | | | | |
|---|---|---|---|---|
| 4,995,924 | A | 2/1991 | Akutsu | |
| 5,089,354 | A * | 2/1992 | Nakashima | C22C 32/0021 419/13 |
| 5,624,475 | A | 4/1997 | Nadkarni et al. | |
| 6,165,246 | A | 12/2000 | Kira et al. | |
| 8,349,097 | B2 | 1/2013 | Lo et al. | |
| 2004/0165638 | A1 | 8/2004 | Morton et al. | |
| 2011/0061774 | A1* | 3/2011 | Lo | B22D 7/005 148/553 |

FOREIGN PATENT DOCUMENTS

| | | | |
|---|---|---|---|
| CN | 102560163 | B | 7/2012 |
| CN | 102899524 | A | 1/2013 |
| CN | 103451470 | A | 12/2013 |
| JP | S6086236 | A | 5/1985 |
| JP | H04131339 | A | 5/1992 |
| JP | H07118777 | A | 5/1995 |
| JP | H11124646 | A | 5/1999 |
| JP | 2013197862 | A | 9/2013 |
| KR | 1020120042483 | A | 5/2012 |
| SU | 1490907 | A1 | 9/1996 |

OTHER PUBLICATIONS

International Search Report regarding Application No. PCT/EP2014/074384, dated Jan. 5, 2016.
Written Opinion regarding Application No. PCT/EP2014/074384, dated Jan. 5, 2016.
Marashi M.S., et al.: "Synthesis of Alumina Reinforced Nanostructured Alpha-Brass by Mechanochemical Reduction of CuO and ZnO with Al and C", Materials Chemistry and Physics, vol. 122, No. 2-3, Aug. 1, 2010.
JP Office Action dated Oct. 25, 2016 from a corresponding application.
CN Office Action dated Apr. 18, 2017, corresponding to CN patent applicaton No. 201480061712.2.

* cited by examiner

*Primary Examiner* — Weiping Zhu
(74) *Attorney, Agent, or Firm* — Harness, Dickey & Pierce, P.L.C.

(57) ABSTRACT

The present invention refers to a brass alloy, wherein $Al_2O_3$ is present in the alloy in the form of ceramic nanoparticles. Furthermore the invention refers to a method for production of the brass alloy.

20 Claims, 4 Drawing Sheets

BRASS ALLOY COMPRISING CERAMIC ALUMINA NANOPARTICLES AND HAVING IMPROVED MACHINABILITY

CROSS REFERENCE TO RELATED APPLICATIONS

This application is a U.S. National Phase under 35 U.S.C. 371 of International Application No. PCT/EP2014/074384, filed Nov. 12, 2014, and published in English as WO2015/071316 A2 on May 21, 2015. This application is based on and claims priority to Swedish Application No. 1351337-9, filed Nov. 13, 2013. The entire disclosures of the above applications are incorporated herein by reference.

TECHNICAL FIELD

The present invention refers to a brass alloy with maximum 0.25% by weight Pb and to a method to produce the brass alloy, wherein $Al_2O_3$ is present in the alloy in the form of ceramic nanoparticles resulting in cutting advantages.

BACKGROUND

Brass is a material involving many opportunities and fields of application. The basic constituents are copper (Cu) and zinc (Zn). By additives of different alloying material such as i. a. lead (Pb), tin (Sn), iron (Fe), aluminum (Al), nickel (Ni), manganese (Mn), silicon (Si) and/or arsenic (As) the brass can be given unique properties and there are many different brass qualities for different types of machining and end products. Brass may as well involve antimony (Sb), phosphorous (P), boron (B) and/or sulfur (S).

Brass can be made in the form of bars, profiles and blooms being semi-finished products to be further refined. Samples of such end products are screws, nuts, water and sanitary armatures, lock details, electric components, ornamental objects etc. Above all brass is a closed cycle material having its given place in an environmental promoting workshop production. Brass is profitable to be recovered and therefore almost 80 percent of the raw material is in the form of brass scrap, partly as waste material from the workshop industry and partly from recovery enterprises.

The percentage 0.2 of Pb is obtained from the definition of the so called *Hygienic Copper Alloy Composition List*, of lead free brass. Alloys of brass and other metals and materials being in contact with drinking water are controlled by this list and will be valid from Dec. 1, 2013 in those countries which have signed the 4MS, (Four Member State), declaration, a work being an extension of the previous EAS (European Acceptance Scheme), work started in 1997 and being sanctioned by the EU-commission. The target with the 4MS declaration is to create a common directive for all the 27 EU countries. Moreover there are similar regulations of the Pb percentage in brass alloys in other countries like the USA. The main difference between USA and Europe is that in the USA one is focused on restrictions of lead in separate articles (the average value being max 0.25% by weight Pb) while in Europe it is focused on the restriction of lead in the drinking water as such. The value allowed in the drinking water as such is higher in the USA than in Europe, 15 and 10 μg/l respectively [1]. Samples of brass alloys meeting the requirements of being defined as lead free brass are CW511L and EcoBrass® [1, 2].

In connection with these environmental demands on the precipitation of Pb in drinking water there is also the demand for eliminating Pb in the material as such. These work is in progress through different governmental stipulations but also on voluntary basis by so called environmentally classified systems. As an example in Sweden one can mention the Building Material Assessment (Byggvarubedömningen) and Basta, where lead free alloys are a demand.

The brass alloys with the EN-number CW614N and CW617N are two of the most common brass alloys for cut machining and forging [3]. For instance these alloys are used for water and sanitary armatures, oil and gas armatures as well as for many different details at the electric, engineering and car industry. The alloys are easy to polish and to surface for having a very high surface finish. The CW614N comprises 39% by weight Zn, 3% by weight Pb and the rest is Cu and thus has the composition designing CuZn39Pb3. The CW614N is also referred to as a free-cutting brass as it is used for automatic machining, and CW617N is used for hot forged details.

By adding lead to brass alloys such as the CW614N the machinability is enhanced. A small part of 0.2% by weight is dissolved, the lead atoms are much larger than the copper and zinc atoms and due to their size they lock the dislocation movements. This enhances among others the chip breaking being of great importance. The rest forms a lead-copper phase being precipitated at the grain boundaries. This phase melts at the temperatures prevailing in the cut zone and the molten metal acts as a lubricant during the cut progress. By lowering the Pb below 0.2% by weight one obtains a very deteriorated machinability generally seen.

The part of the lead-copper phase being precipitated at the grain boundaries will be a part of the surfaces of the work piece by the cutting machining. The phase is more and easier stretched out than the remaining parts due to the low strength and high ductility, it may also be liquid. These surfaces will be found in products/components, water taps, being in contact with drinking water. In this way lead may be leached to the water and have an injurious effect on our health.

Another aspect is that the brass may be dezincificated by intergranulated corrosion (4) and thereby expose the remaining grain structure. A minimal addition of Pb is favorable since also these grains can be in contact with water.

However, the absence of a lead-copper phase at the grain boundaries impairs the machinability of a copper alloy. The main difficulties with machining include:

1. Deteriorated chip breaking and chip control
2. Chip widening, the chip expands sideways, see FIG. 1
3. Burr formation
4. Build up edge, "BUE", on the cutting tool rake face, which subsequently ends up on the workpiece surfaces
5. Significantly higher cutting forces
6. Vibration tendency is significantly higher due to higher cutting forces in the chip thickness direction, see FIG. 2.

Thus there is a great need for an improved brass alloy with significantly less addition of lead Pb without impairing machinability.

PURPOSE OF THE INVENTION

The purpose of the present invention is to provide brass alloy which has equal or a similar cutting ability as a so called free-cutting brass with ca. 3% by weight Pb.

Furthermore the purpose is that the brass alloy comprises maximum 0.25% by weight Pb (±0.02% by weight), preferably ≤20% by weight Pb, that is no lead in the grain boundaries, only in the part to be dissolved. Thereby the brass alloy may be labelled as lead free brass in the USA and in the EU.

The purpose is also to produce a brass alloy having a similar or enhanced cutting ability than other lead free brasses such as CW511L and EcoBrass®.

SUMMARY OF THE INVENTION

By the present invention, as it is defined by the independent claims, the purposes mentioned above are met with and furthermore the cutting difficulties mentioned above have been eliminated. Suitable embodiments of the invention are defined by the dependent claims.

The invention refers to a brass alloy and a method for production of the brass alloy, wherein alumina ($Al_2O_3$) is present in the alloy in the form of ceramic nanoparticles. These ceramic nanoparticles are undeformable particles, i. e. hard inclusions resulting in technical cutting preferences.

According to a preferred embodiment the brass alloy comprises 61.5 through 64.2% by weight Cu, 35.6 through 37.4% by weight Zn, 0.100 through 0.250% by weight Pb, 0 through 0.15% by weight As, and 0.04 through 0.1% by weight, preferably 0.04 through 0.06% by weight $Al_2O_3$, wherein $Al_2O_3$ is present in the alloy in the form of ceramic nanoparticles.

According to a preferred embodiment the brass alloy comprises 61.5 through 63.5% by weight Cu, 35.6 through 37.4% by weight Zn, 0.100 through 0.250% by weight Pb, 0 through 0.15% by weight Sn, 0 through 0.15% by weight Fe, 0 through 1% by weight, preferably 0 through 0.05% by weight or 0.45 through 0.7% by weight Al, 0 through 0.149% by weight Ni, 0 through 0.15% by weight Mn, 0 through 0.03% by weight Si, 0 through 0.15% by weight As, 0 through 0.02% by weight P, 0 through 0.02% by weight Sb, 0 through 0.0007% by weight B, and 0.04 through 0.06% by weight $Al_2O_3$, wherein $Al_2O_3$ is present in the alloy in the form of ceramic nanoparticles. Alloy additives like Sn, Fe, Al, Ni, Mn, Si and/or As improve corrosion resistance, strength, wear resistance and/or tensile strength.

According to a preferred embodiment the brass alloy comprises 63.0% by weight Cu, 36.6% by weight Zn, 0.2% by weight Pb, 0.1% by weight As, 0.0005% by weight B, and 0.05% by weight $Al_2O_3$. The alloy additive As results in a protection against dezincification. The small content of Pb of 0.2% by weight make it possible for the brass alloy to meet with the definition of lead free brass.

According to a preferred embodiment the brass alloy comprises 63.1% by weight Cu, 36.7% by weight Zn, 0.145% by weight Pb, 0.04% by weight As, and 0.05% by weight $Al_2O_3$. The alloy additive As results in a protection against dezincification. The small content of Pb of 0.145% by weight make it possible for the brass alloy to meet with the definition of lead free brass.

According to a preferred embodiment the brass alloy comprises nanoparticles of $Al_2O_3$ being essentially spherical. Thereby the essentially spherical nanoparticles of $Al_2O_3$ have a form similar to the form of the deformed workpiece material grains in the secondary and tertiary cutting zone. Furthermore spherical nanoparticles of $Al_2O_3$ have the advantage not to affect the length of the tool life unlike angular nanoparticles which have an abrasive action on and greatly reduce the length of the tool life.

According to a preferred embodiment the brass alloy comprises nanoparticles of $Al_2O_3$ being in the form of artefacts. The artificial ceramic nanoparticles of $Al_2O_3$, i.e. the artefacts, are a very effective way to control the weight and form of the $Al_2O_3$ to obtain the advantages of the cutting technique.

According to a preferred embodiment the brass alloy comprises nanoparticles of $Al_2O_3$ having a diameter of 100 through 1000 nm. Thereby the diameter of the nanoparticles of $Al_2O_3$ in the brass alloy is of same order as the thickness of the deformed workpiece material grains in the secondary and tertiary cutting zone of the brass alloy.

According to a preferred embodiment the brass alloy comprises nanoparticles of $Al_2O_3$ having a diameter of 500 nm. Thereby the diameter of the nanoparticles of $Al_2O_3$ in the brass alloy is of the same order as the thickness of the deformed workpiece material grains in the secondary and tertiary cutting zone of the brass alloy.

According to a preferred embodiment the preferred brass alloys mentioned above are made by a method where nanoparticles of $Al_2O_3$ are added under stirring to a melt bath comprising brass scrap, wherein ceramic nanoparticles of $Al_2O_3$ are added under stirring at the start of the melt process as such, and the said brass scrap in the melt bath comprises the quantity of Cu, Zn, Pb, Sn, Fe, Al, Ni, Mn, Si, As, P, Sb, and/or B to obtain the preferred brass alloy mentioned above. The method also comprises the steps of (i) adding brass scrap to be melted in a furnace up to ⅓ of the desired desired volume, (ii) adding ceramic nanoparticles as a whole, (iii) optionally mixing by stirring in the furnace, and (iv) adding the rest of the brass scrap until the desired volume is obtained. By this method a brass alloy is obtained having a number of advantages of the cutting technique.

According to a preferred embodiment the brass alloy is produced by a process wherein the melt bath has a temperature of 1040° C. By means of induction within the furnace there is a good condition of the stirring effect contributing to a good and even distribution of the $Al_2O_3$ nanoparticles.

DESCRIPTION OF THE INVENTION

Figure 1:
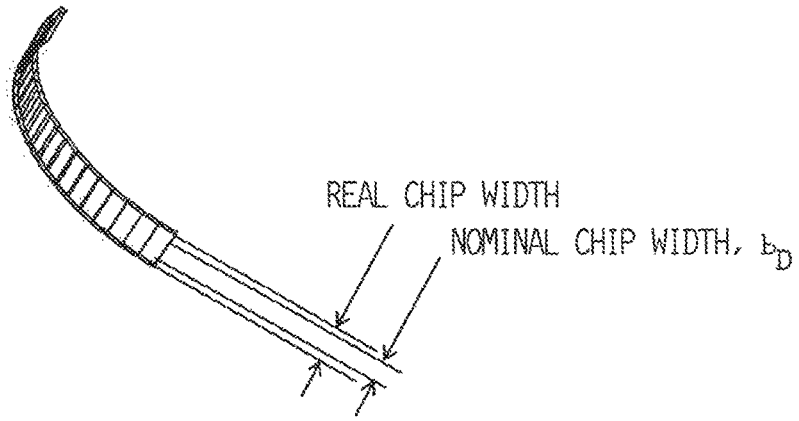
FIG. 1 shows a schematic view of chip widening of a brass alloy according to prior art.
Figure 2:
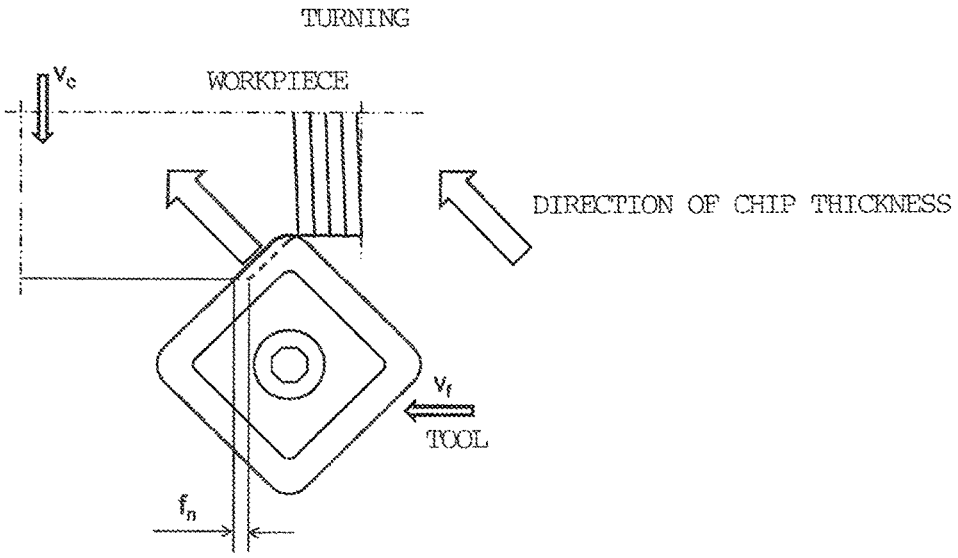
FIG. 2 shows a schematic view of the direction of chip thickness of a brass alloy according to prior art.

The present invention refers to a brass alloy where the additive lead Pb has been restricted from 3% by weight to 0.25% by weight, preferably to ≤20% by weight, and more preferably to 0% by weight, without impairing the cutting ability.

A brass alloy according to the present invention comprises Cu, Zn, Pb, As and $Al_2O_3$, and optional additives of Sn, Fe, Al, Ni, Mn, Sb, P and/or Si, and optional impurities like S and B, wherein $Al_2O_3$ is present in the alloy in the form of ceramic nanoparticles. The brass alloy comprises up to 66% by weight Cu. Preferably the alloy comprises 61.5 through 64.2% by weight Cu, 35.6 through 37.4% by weight Zn, 0.100 through 0.250% by weight Pb, 0 through 0.15% by weight As, and 0.04 through 0.1% by weight, preferably 0.04 through 0.06% by weight $Al_2O_3$, wherein $Al_2O_3$ is present in the alloy in the form of ceramic nanoparticles. More preferrably the alloy comprises 61.5 through 63.5% by weight Cu, 35.6 through 37.4% by weight Zn, 0.100 through 0.250% by weight Pb, 0 through 0.15% by weight Sn, 0 through 0.15% by weight Fe, 0 through 1% by weight, preferably 0 through 0.05% by weight or 0.45 through 0.7% by weight Al, 0 through 0.149% by weight Ni, 0 through 0.15% by weight Mn, 0 through 0.03% by weight Si, 0 through 0.15% by weight As, 0 through 0.02% by weight P, 0 through 0.02% by weight Sb, 0 through 0.0007% by weight B, and 0.04 through 0.06% by weight $Al_2O_3$, wherein $Al_2O_3$ is present in the alloy in the form of ceramic nanoparticles.

The brass alloy comprises alloy additives such as Sn, Fe, Al, Ni, Mn, Si and/or As in order to enhance the corrosion resistance, strength, wear resistance and/or tensile strength. As provides a protection against dezincification, i.e. selective corrosion where zinc reacts with a higher speed than the rest of the alloying elements. An additive of Sn gives a better corrosion resistance and can also contribute to a small increase of the hardness and the tensile strength. The presence of Fe, Mn and Al in the brass alloy contributes to a certain increase of the hardness, strength and tensile strength. Si increases the strength and resistance to wear of the brass alloy. Nickel improves the hardness and tensile strength without any significant effect on the ductility, which results in improved qualities at increased temperatures. Other elements such as Sb, B, P and S may also be present in the alloys.

The brass alloy according to the present invention is produced by a method comprising the adding of alumina nanoparticles having the size of 100 through 1000 nm to a melt bath of brass scrap of about 1040° C. at the beginning of the melting process as such. By means of induction in the furnace there is a good condition of the stirring effect contributing to a good and even distribution. The method also comprises the steps of:

(i) adding brass scrap to be melted in a furnace up to ⅓ of the desired volume, (ii) adding ceramic nanoparticles as a whole, (iii) optionally mixing by stirring in the furnace, and (iv) adding the rest of the brass scrap until the desired volume is obtained.

Figure 3:
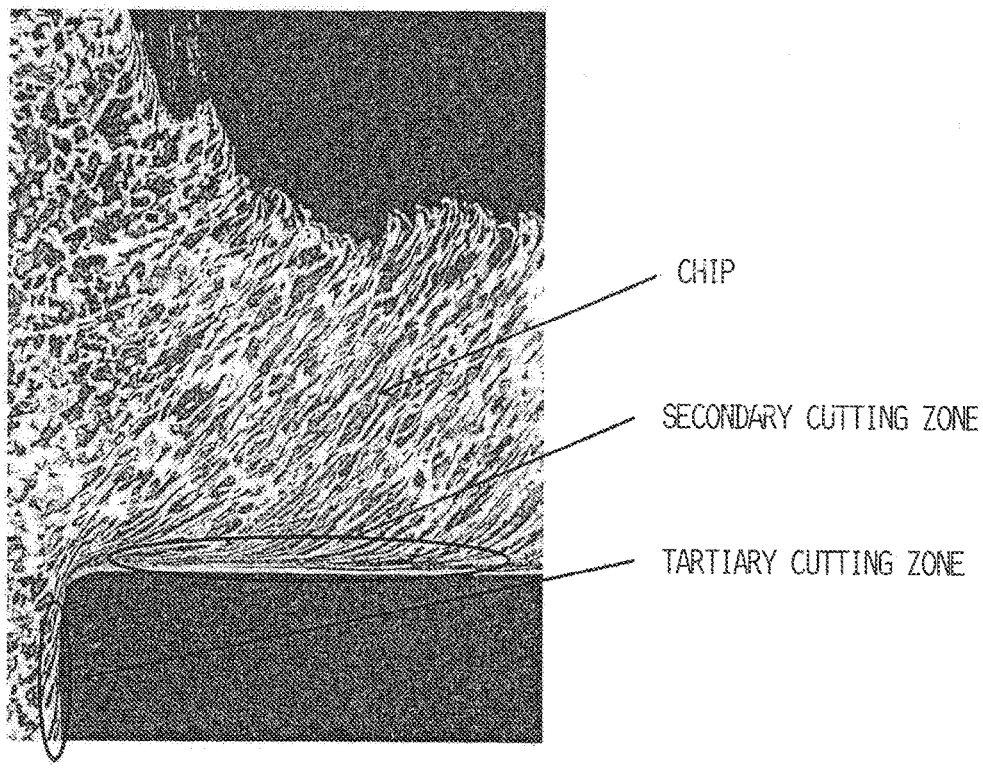
FIG. 3 shows in a schematic way the cutting zone of a brass alloy according to the present invention.
Figure 4:
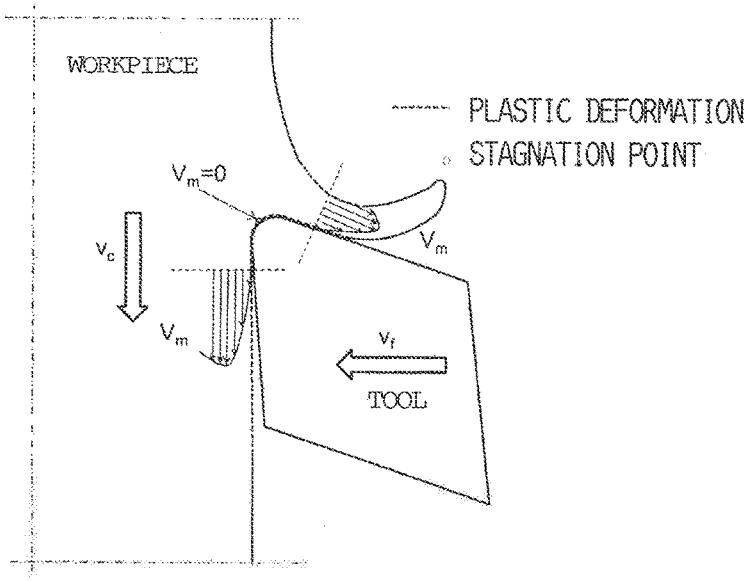
FIG. 4 shows in a schematic way gradients of velocities within the cutting zone of a brass alloy according to the present invention.
Figure 5:
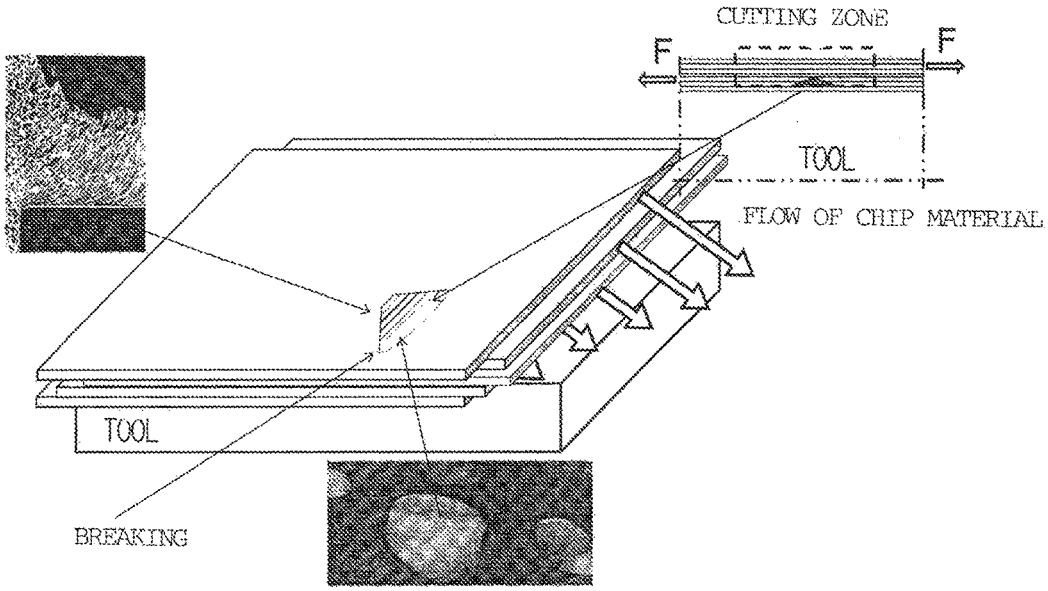
FIG. 5 shows a schematic view of deformation and ruptures inside the cutting zone of the brass alloy according to the present invention.

The $Al_2O_3$ present in the alloy as ceramic nanoparticles has essentially a spherical shape and a diameter of 100 through 1000 nm. The nanoparticles are operating in the secondary and tertiary cutting zones (FIG. 3) where the gradients of velocity of the working material and the chip material are high (FIG. 4) and where the deformations are extremely large. The grains of the working material, having a size of 10 through 100 μm, are stretched to plates being several hundred nm thick before rupture (FIG. 5).

By adding of a small amount ceramic nanoparticles having a size of the same order as the thickness of the deformed grains of the working material in the secondary and tertiary cutting zones one obtains a number of technical cutting advantages.

1. The ceramic nanoparticles, which are not deformed plastically, act as indications of fracture in the cutting zones.
2. The tension field around the particles and the particles as such catches the dislocations and makes the chip material brittle.
3. The lowered ductility of the chip material decreases the cutting force in the direction of the chip thickness, which lowers the tendency of self-oscillation when machining.
4. The lowered ductility results also in a reduced burr formation and reduced chip extension.
5. The particles have also a positive effect on the formation of loose edges.

Figure 6:
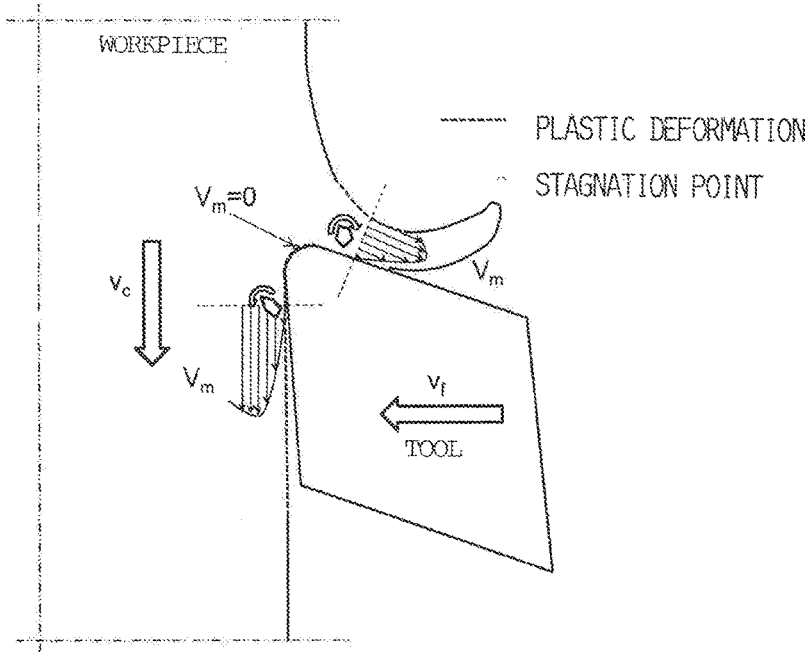
FIG. 6 shows in a schematic way particle spin of a brass alloy according to the present invention.
Figure 7:
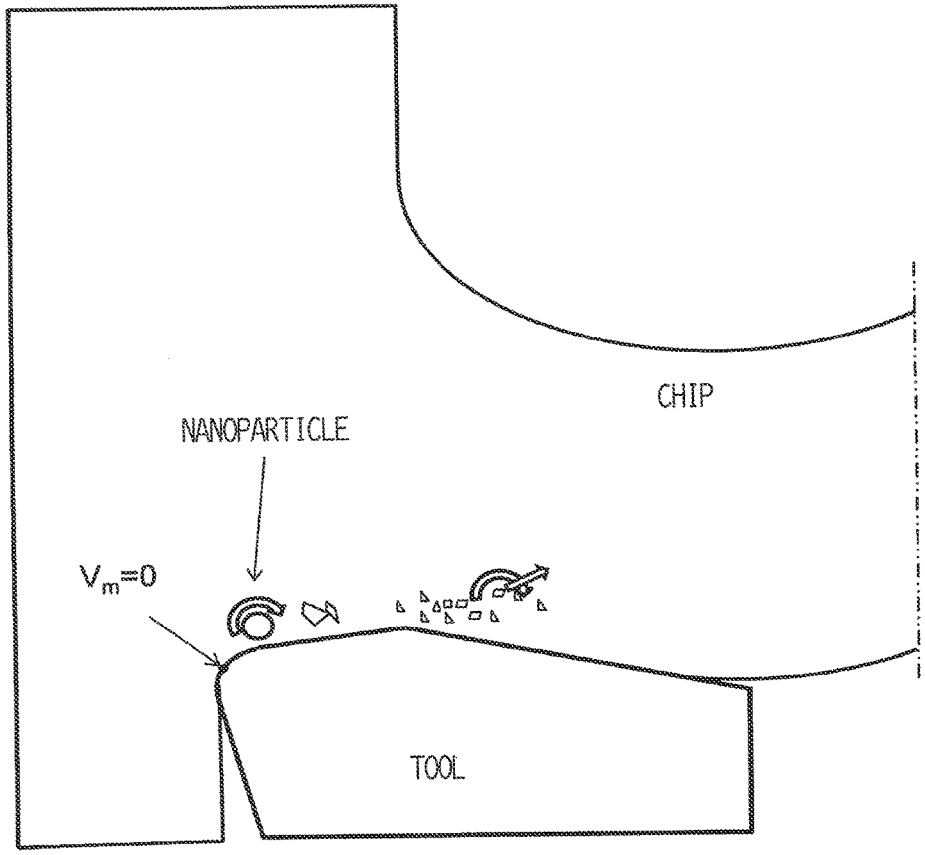
FIG. 7 shows in a schematic way how the ceramic particles fall apart in a brass alloy according to the present invention.

The gradients of velocity in the cutting zones result in that the nanoparticles are rotating, spinning (FIG. 6). In such a spin the particle is exposed for great stresses. Some of the ceramic particles will break into several minor fragments. Ceramic materials are fairly brittle and do not resist any larger stress in the tensile direction. When the ceramic particle rupture, presumably close to the stagnation point (FIG. 7), it will have a function like a "torpedo". The splinters of the "torpedo" embrittle the chip material more than only a particle.

The following examples further describe and demonstrate embodiments within the scope of the present invention. The examples are given solely for the purpose of illustration and are not to be construed as limitations of the present invention, as many variations thereof are possible without departing from the scope of the invention.

Example 1

A brass alloy comprising 63.0% by weight Cu, 36.6% by weight Zn, 0.2% by weight Pb, 0.1% by weight As, and 0.0005% by weight B and 0.05% by weight $Al_2O_3$, was produced by introducing spherical ceramic nanoparticles of $Al_2O_3$, having a diameter of 500 nm, under stirring, to a melt bath comprising brass scrap at the beginning of the melting process, wherein the melt bath had a temperature of 1040° C. The brass scrap comprised the amount of alloy additives to obtain the final composition of the alloy. The method also comprised the steps of:

i. adding brass scrap to be melted in a furnace up to ⅓ of the desired volume, ii. adding ceramic nanoparticles as a whole, iii. optionally mixing by stirring in the furnace, and iv. adding the rest of the brass scrap until the desired volume is obtained.

The brass alloy obtained is referred to as CW511L-50X below. In the Table below the allowable ranges have been indicated in the form of minimum and maximum amounts (in % by weight) of the alloy additives Sn, Fe, Al, Ni, Mn, Si and Sb and the impurity S. Comparative studies were made with the brass alloys having the EN numbers CW511L and CW614N and their compositions (see the standard values in the Table) and allowable ranges (min, max) are indicated in the Table below. Comparative studies were made as well with EcoBrass® being a brass alloy with the EN number CW724R which comprises 75 through 77% by weight Cu, 3% by weight Si and the rest % by weight being Zn. EcoBrass® also comprises 0.1 through 0.12% by weight Pb and thus meet with the designation lead free brass.

| Alloy | Chemical elements | Cu | Zn | Pb | Sn | Fe | Al | $Al_2O_3$, 500 nm | Ni | Mn | Si | As | Sb | B | Other elements |
|---|---|---|---|---|---|---|---|---|---|---|---|---|---|---|---|
| CW511L-50X | min | 61.5 | Rest | 0.1 | | | | | | | | 0.06 | | 0.0003 | Fe + Mn + Sb + Si |
| | Std. value | 63 | | 0.2 | | | | | | | | 0.1 | | 0.0005 | |
| | max | 63.5 | Rest | 0.25 | 0.1 | 0.1 | — | 0.05 | 0.1 | 0.01 | 0.03 | 0.15 | 0.01 | 0.0007 | 0.2 |

-continued

| Alloy | Chemical elements | Cu | Zn | Pb | Sn | Fe | Al | $Al_2O_3$, 500 nm | Ni | Mn | Si | As | Sb | B | Other elements |
|---|---|---|---|---|---|---|---|---|---|---|---|---|---|---|---|
| CW511L | min | 61.5 | Rest | 0.1 | | | | | | | | 0.06 | | 0.0003 | Fe + Mn + Sb + Si |
| | Std. value | 63 | | 0.2 | | | | | | | | 0.1 | | 0.0005 | |
| | max | 63.5 | Rest | 0.25 | 0.1 | 0.1 | 0.05 | — | 0.1 | 0.01 | 0.03 | 0.15 | 0.01 | 0.0007 | 0.2 |
| CW614N | min | 57 | Rest | 2.5 | | | | | | | | | | | Fe + Mn + Sb + Si |
| | Std. value | 57.4 | | 3 | | | | | | | | | | | |
| | max | 59 | Rest | 3.5 | 0.3 | 0.3 | 0.05 | — | 0.2 | | 0.06 | | 0.01 | | 0.2 |

The comparative studies demonstrated both improved and unexpected technical effects of the CW511L-50X. The results show that the brass alloy incorporating nanoparticles of $Al_2O_3$ were about similar to those of the free-cutting brass CW614N, which comprises about 3% by weight lead with respect to the vibration tendency. In addition to that lower cutting forces were obtained and that the chip breaking was acceptable, i. e. the chips made no problem. Furthermore the formations of burrs, loose edges and chip widening were considerably better than without particles.

Compared to the reference material CW511L the CW511L-50X was definitely better with respect to cutting forces and vibration tendency. The chip breaking was equal to that of CW511L but considerably better than that of EcoBrass. In the extruded bars (with a diameter of 50 mm) being examined there were only little differences in cutting ability, which indicates that the particles had a good dispersion. Nothing indicated that the particles would have any drastic effect on the life length of the tool. Roughly the vibration tendency of the CW511L-50X was equal to that of EcoBrass. The formation of burrs was equal to that of EcoBrass and much better compared with that of CW511L.

The formation of loose edges of the CW511L-50X demonstrated an unexpected technical effect as almost no depositions could be detected, which is considerably better than that of CW511L and better than that of EcoBrass. That the additives of the ceramic $Al_2O_3$ particles would have an influence on the loose edge formation is surprising. Loose edge formation is important due to that the machined details have to be free from depositions. Generally the soft ductile materials are those that have most problems with loose edge and in this case it seems as if the chip material being in contact with the workpiece has been harder because the dislocation was locked by particles and splinters. The tension field around the particles and the splinters thereof lock the dislocations and render further plasticizing more difficult, i. e. it makes the chip material more brittle.

Ductile materials mostly being almost clean, lack larger amounts of particles or hard confinements, often generate a lot of loose edges. If these materials are hardened by precipitation-hardening one will often have less problems with loose edge formation. A similar effect seems to be obtained by the current particles and their splinters in the brass alloy CW511L-50X, i. e. the preferred brass alloy according to the present invention.

An indication of this being the case is that the yield strength of the CW511L-50X was considerable higher (ca. 30%). The particles that do not fit into the lattice are surrounded by a tension field rendering the dislocation movements more difficult, i. e. more force is needed to move a dislocation. As the nanoparticles in the grain boundaries have an effect on the direction and shift of the sliding planes, and even the dislocation movements, this will result into an enhanced inertia which in turn increases the yield strength.

Example 2

A brass alloy comprising 63.1% by weight Cu, 36.7% by weight Zn, 0.145% by weight Pb, 0.06% by weight As, and 0.06% by weight $Al_2O_3$, was produced by introducing spherical ceramic nanoparticles of $Al_2O_3$, having a diameter of 500 nm, under stirring, to a melt bath comprising brass scrap at the beginning of the melting process, wherein the melt bath had a temperature of 1040° C. The brass scrap comprised the amount of alloy additives to obtain the final composition of the alloy.

The brass alloy according to Example 2 had similar properties to those of the brass alloy according to Example 1.

REFERENCES 1. http://www.svensktvatten.se/PageFiles/3562/Nilsson.pdf
2. http://www.diehl.com/en/diehl-metall/company/brands/diehl-metall-messing/ecomerica/alloys.html
3. http://www.nordicbrass.se/PRODUKTER/Översiktstånglegeringar/tabid/88/language/sv-SE/Default.aspx
4. O Rod, Swerea Kimab, Sweden

The invention claimed is:

1. A brass alloy comprising Cu, Zn, 0 through 0.2% by weight Pb and 0.04 through 0.06% by weight $Al_2O_3$, wherein $Al_2O_3$ is present in the alloy in the form of ceramic nanoparticles.

2. A brass alloy according to claim 1 that further comprises As, and optional additives of Sn, Fe, Al, Ni, Mn and/or Si.

3. A brass alloy according to claim 1 comprising 61.5 through 64.2% by weight Cu, 35.6 through 37.4% by weight Zn, 0 through 0.1% by weight Pb, and 0.04 through 0.06% by weight $Al_2O_3$.

4. A brass alloy according to claim 1 that further comprises 0 through 0.15% by weight As.

5. A brass alloy according to claim 1 comprising 61.5 through 63.5% by weight Cu, 35.6 through 37.4% by weight Zn, 0 through 0.1% by weight Pb, 0 through 0.15% by weight Sn, 0 through 0.15% by weight Fe, 0 through 1% by weight Al, 0 through 0.149% by weight Ni, 0 through 0.15% by weight Mn, 0 through 0.03% by weight Si, 0 through 0.15% by weight As, 0 through 0.02% by weight P, 0 through 0.02% by weight Sb, 0 through 0.0007% by weight B, and 0.04 through 0.06% by weight $Al_2O_3$, wherein $Al_2O_3$ is present in the alloy in the form of ceramic nanoparticles.

6. A brass alloy according to claim 5 wherein Al is present in a concentration of 0 through 0.05% by weight or 0.45 through 0.7% by weight.

7. A brass alloy according to claim 1 comprising 61.5 through 63.5% by weight Cu, 0 through 0.1% by weight Pb, 0 through 0.1% by weight Sn, 0 through 0.1% by weight Fe, 0 through 0.1% by weight Ni, 0 through 0.01% by weight Mn, 0 through 0.03% by weight Si, 0.06 through 0.15% by weight As, 0.0003 through 0.0007% by weight B, and 0.05% by weight $Al_2O_3$, wherein the sum of Sn, Fe, Ni, Mn and Si in the brass alloy is maximally 0.2% by weight, and wherein the rest % by weight of the alloy comprises Zn.

8. A brass alloy according to claim 7 comprising 63.0% by weight Cu, 36.6% by weight Zn, 0 through 0.1% by weight Pb, 0.1% by weight As, 0.0005% by weight B, and 0.05% by weight $Al_2O_3$.

9. A brass alloy according to claim 1 comprising 62.5 through 63.5% by weight Cu, 35.6 through 37.4% by weight Zn, 0 through 0.1% by weight Pb, 0 through 0.15% by weight Sn, 0 through 0.15% by weight Fe, 0 through 0.05% by weight or 0.45 through 0.7% by weight Al, 0 through 0.149% by weight Ni, 0 through 0.15% by weight Mn, 0 through 0.03% by weight Si, 0 through 0.02% by weight P, and 0.04 through 0.06% by weight $Al_2O_3$.

10. A brass alloy according to claim 9 comprising 63.1% by weight Cu, 36.7% by weight Zn, 0 through 0.1% by weight Pb, and 0.05% by weight $Al_2O_3$; and further comprising 0.04% by weight As.

11. A brass alloy according to claim 1, wherein said nanoparticles of $Al_2O_3$ are spherical.

12. A brass alloy according to claim 1, wherein said nanoparticles of $Al_2O_3$ are artefacts.

13. A brass alloy according to claim 1, wherein said nanoparticles of $Al_2O_3$ have a diameter of 100 through 1000 nm.

14. A brass alloy according to claim 13, wherein said nanoparticles of $Al_2O_3$ have a diameter of 500 nm.

15. A method of production of a brass alloy according to claim 1, wherein that nanoparticles of $Al_2O_3$ are added at the start of the melting process as such to a melt bath comprising brass scrap, said brass scrap in the melt bath comprises the quantity of Cu, Zn, Pb, Sn, Fe, Al, Ni, Mn, Si, As, Sb, B and/or P of the brass alloy according to claim 1.

16. A method according to claim 15, wherein the melt bath has a temperature of 1040° C.

17. A method according to claim 15, comprising the steps of:

i. adding brass scrap to be melted in a furnace up to ⅓ of the desired volume, ii. adding ceramic nanoparticles as a whole, iii. optionally mixing by stirring in the furnace, and iv. adding the rest of the brass scrap until the desired volume is obtained.

18. Use of the brass alloy according to claim 1 for manufacturing bars, profiles or blooms.

19. Use of the brass alloy according to claim 1 for manufacturing screws, nuts, water armatures, sanitary armatures, lock details, electric components, ornamental objects, oil armatures, gas armatures, or for manufacturing different components of the details applied for the electric, engineering and car industry.

20. Articles comprising the brass alloy according to claim 1.

* * * * *